United States Patent [19]

Schold

[11] 4,197,019

[45] Apr. 8, 1980

[54] DUAL DRIVE CO-AXIAL DISPERSER

[76] Inventor: George R. Schold, 7909 2nd St. North, St. Petersburg, Fla. 33702

[21] Appl. No.: 2,745

[22] Filed: Jan. 11, 1979

[51] Int. Cl.[2] ..... B01F 7/16

[52] U.S. Cl. ..... 366/294

[58] Field of Search ..... 366/294, 295, 296, 293, 366/246

[56] References Cited

U.S. PATENT DOCUMENTS

| | | | |
|---|---|---|---|
| 1,598,185 | 8/1926 | Willard | 366/294 |
| 2,367,279 | 1/1945 | Houlton | 366/293 |
| 3,163,405 | 12/1964 | Balassa | 366/270 |
| 3,252,690 | 5/1966 | Martin | 366/296 |

*Primary Examiner*—Robert W. Jenkins
*Attorney, Agent, or Firm*—Frank R. Thienpont

[57] ABSTRACT

A mixing machine for dispersing finely divided solid particles in a liquid vehicle including a pair of co-axially extending shafts with an impeller disposed on the end of each shaft, said shafts being separately driven by a pair of variable speed drive motors, one of the impellers being a relatively smaller high speed impeller and the other of said impellers being a relatively larger low speed impeller. The high speed impeller is disposed adjacent to and in co-axial relationship with the low speed impeller with the radial spacing between the periphery of the high speed impeller and internal wall portions formed on the low speed impeller being extremely small whereby a shearing action is imparted to agglomerates being processed in the mixture as they pass through the space between the periphery of the high speed impeller and the wall portions on the low speed impeller.

7 Claims, 10 Drawing Figures

Fig. 5.
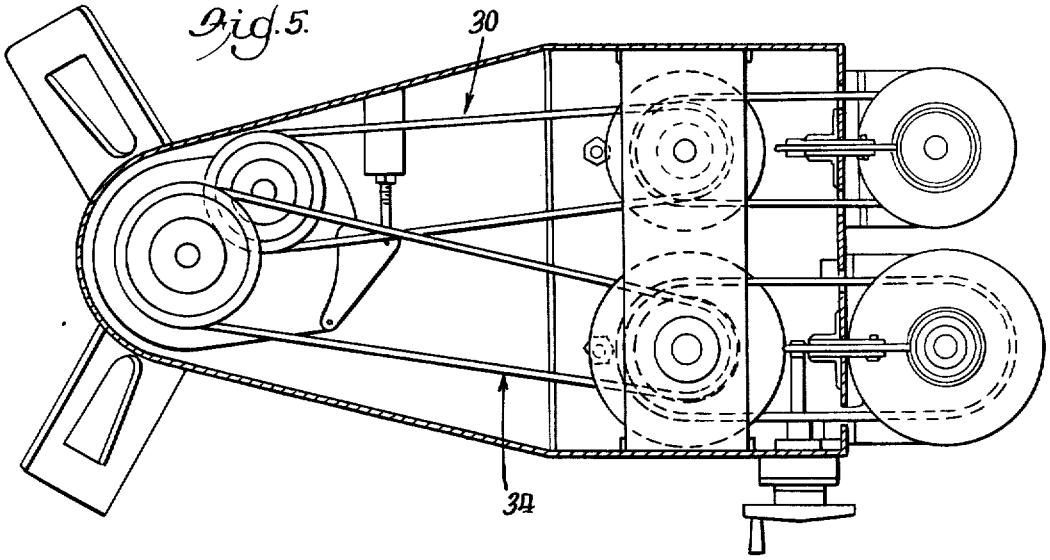
Fig. 6.
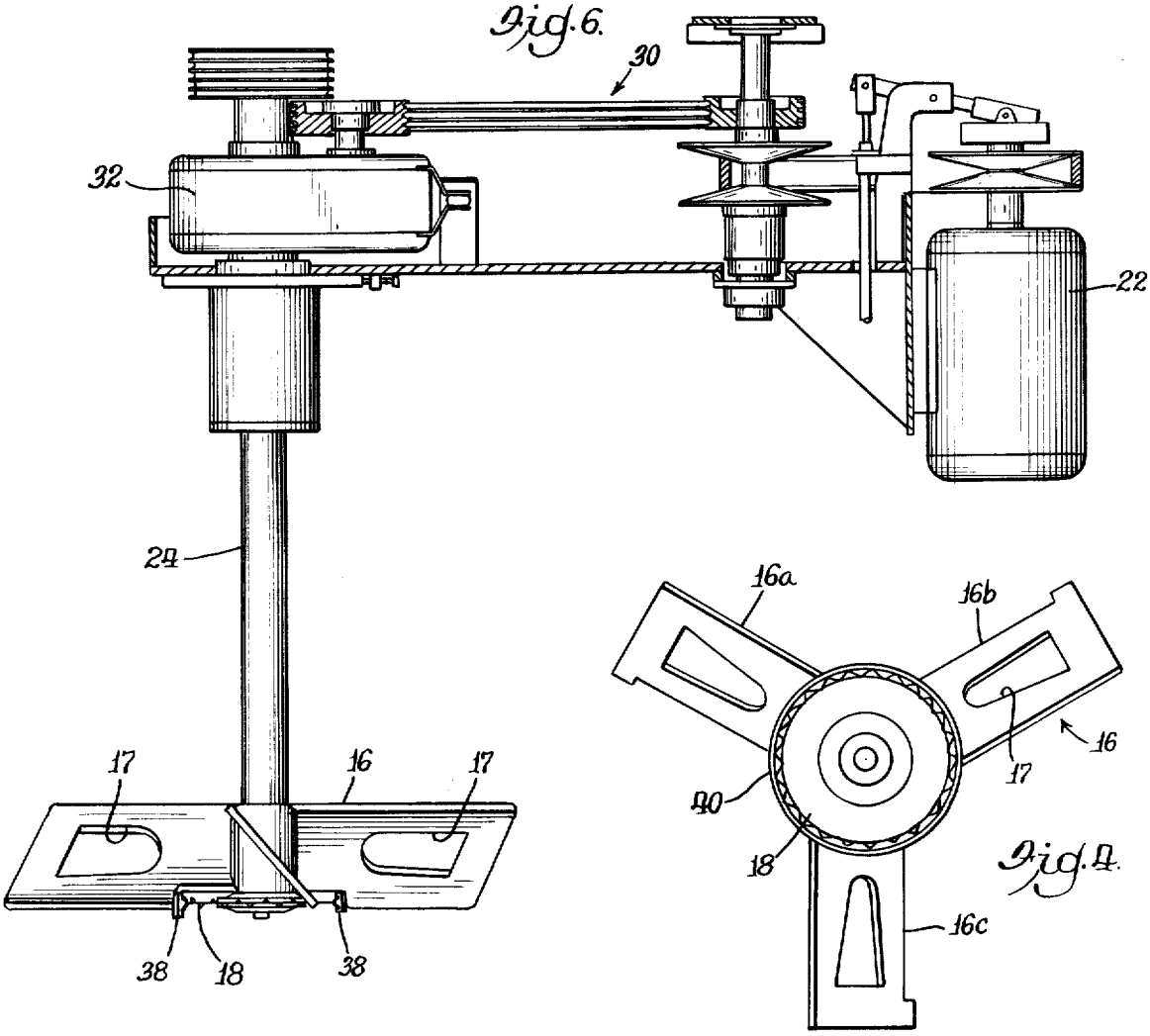
Fig. 4.

Fig. 7.
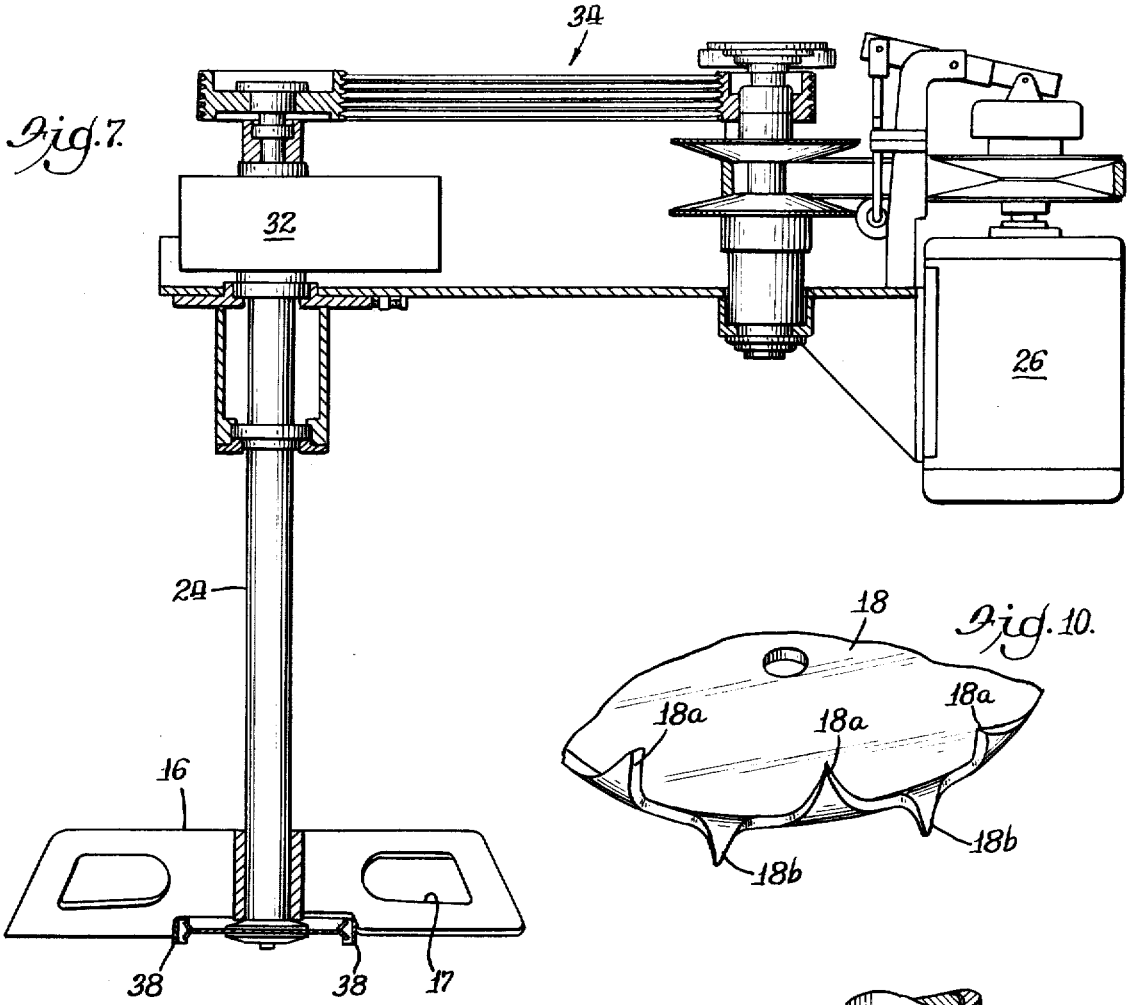
Fig. 10.
Fig. 8.
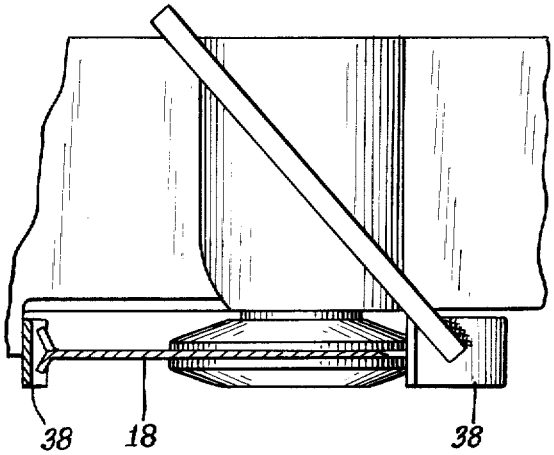
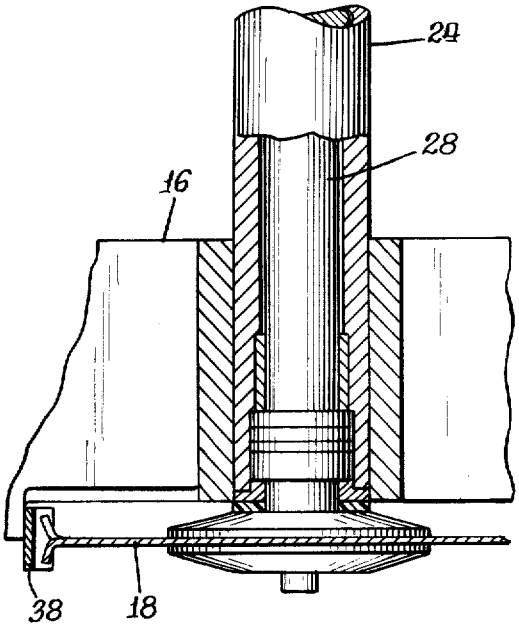
Fig. 9.

DUAL DRIVE CO-AXIAL DISPERSER

BACKGROUND OF THE INVENTION

This invention relates to dispersing machines for dispersing solid particles in a liquid vehicle.

Machines of this general type are disclosed, for example, in U.S. Pat. No. 3,342,459 for Mixer with Different Speed Impellers issued Sept. 19, 1967.

A continuing problem in processing a wide variety of materials is the task of effectively breaking up the agglomerates in the mixture and accomplishing this task in reduced periods of time. This occurs in the mixing and dispersing of product with a wide range of viscosities including such products, for example, as inks, caulks, dyestuffs, paints, adhesives, resins, etc.

SUMMARY OF THE INVENTION

An object of the present invention is to provide in a dispersing apparatus of the type herein described a pair of co-axially disposed agitator impellers wherein the smaller of the two impellers is co-axially mounted in relation to the larger of the two impellers with the periphery of the smaller impeller being positioned in closely space relationship with wall portions formed on the larger of the two impellers.

Another object of the invention is to provide in a dispersing apparatus coacting high speed and low speed impellers which are capable of dispersing and breaking down agglomerates in a fluid mixture in a minimal amount of time.

Other objects and advantages of this invention will become more apparent from reading the following description in conjunction with the accompany drawings.

BRIEF DESCRIPTION OF THE DRAWINGS

FIG. 4 is a bottom view of a low and high speed impeller arrangement with a continuous annular ring secured to the low speed impeller;

FIG. 5 is a plan view of the dual motor drive for the low and high speed impeller shafts;

FIG. 6 is a side view of the high speed drive;

FIG. 7 is a side view of the low speed drive;

FIG. 8 is an enlarged partial broken-away side view of the low speed impeller and the high speed impeller;

FIG. 9 is an enlarged partial view of the low speed impeller shaft and high speed impeller shaft, FIG. 10 is a perspective view, partially broken away, of a high speed impeller blade of the type that may be used in the apparatus described.

DESCRIPTION OF THE PREFERRED EMBODIMENT

Figure 1:
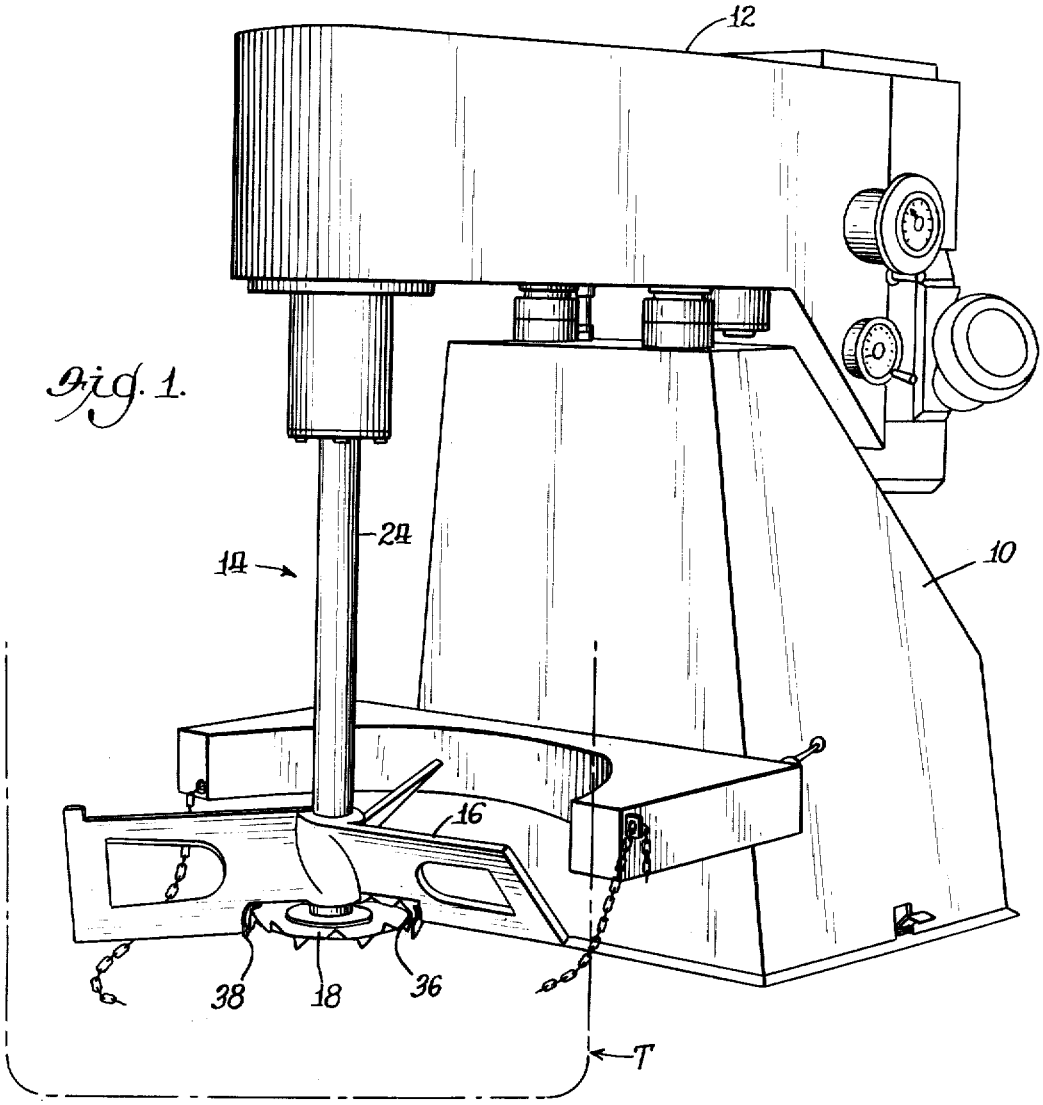
FIG. 1 is a perspective view of a dispersing apparatus embodying the invention herein.
Figure 2:
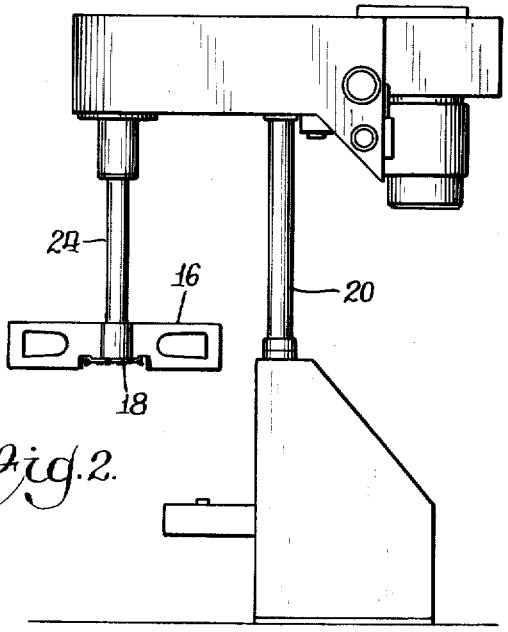
FIG. 2 is a side view of the apparatus of FIG. 1 with the shaft mounted impellers disposed in a lifted position.

Referring now to the drawings, FIG. 1 shows the overall dispersing apparatus including a base or mounting frame 10, a motor drive assembly 12, an agitator drive shaft assembly 14 and a low speed impeller or agitator 16 and a high speed impeller or agitator 18 attached to the drive shaft assembly 14. FIG. 2 shows in a side view the motor drive assembly 12 and drive shaft assembly 14 with attached impellers moved to a raised position by means of hydraulically operated pistons 20. A mixing tank in which the material processing takes place is shown in phantom as T in FIG. 1.

The motor drive assembly 12 comprises a first variable speed motor 22 for driving a low speed agitator shaft 24, and a second variable speed motor 26 for driving a high speed agitator shaft 28. The high speed agitator shaft 28 is mounted coaxially with and extends through the low speed agitator shaft 24 as seen in FIG. 9.

The drive shaft assembly 14 comprises an inner high speed agitator shaft 28 and an outer low speed agitator shaft 26. The low speed shaft 26 is a tubular unit and is connected to and drives the low speed impeller 16. The high speed shaft 28 is disposed coaxially within and extends through the low speed shaft 26 and is connected to and drives the high speed impeller 18.

The first belt and pulley drive arrangement 30 interconnects the variable speed motor 22 and the low speed agitator shaft 24 through a speed reducer 32. A second belt and pulley arrangement 34 interconnects the variable speed motor 26 and the high speed agitator shaft 28.

Figure 3:
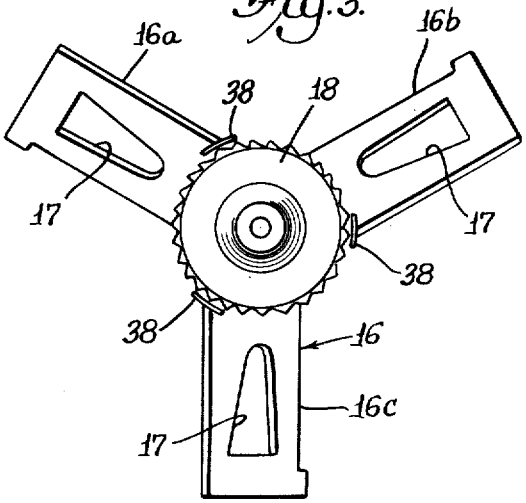
FIG. 3 is a bottom view of the low and high speed impeller arrangement showing curved lug members secured to the low speed impeller.

The low speed impeller 16 comprises a construction having three equi-angular spaced arms **16*a*, 16*b* and 16*c*. The impeller 16 is attached to the outer low speed shaft 24 at the lower end thereof. Each of the arms 16*a*, 16*b* and 16*c* comprise a flat, tilted blade-like structure as seen, for example, in FIGS. 1 and 3. Each blade is formed with openings 17. The blades of the low speed impeller may be formed with cut-out or recessed portions 36 on their lower side to encompass the high speed impeller 18. There is attached to each of the blades of the low speed impeller curved lugs 38 as seen in FIG. 3, for example, to form wall portions which may be shaped substantially to the curvature of the periphery of the high speed impeller blade 18**. The height of such wall portions may be about 1½" to 1¾" and usually are about the same height as or a little higher than the height of the periphery of the high speed impeller.

The high speed impeller 18 may be a flat, annular blade having formed in the outer edge thereof bent out portions **18*a* and 18*b*** so as to create a relatively wide blade periphery. The peripheral edge of the annular blade may be formed with alternate portions bent out from the plane of the blade in opposite directions to give a sawtooth-like effect. This provides an effective peripheral edge height of many times the blade thickness, such peripheral edge height being preferably about 1¼" to 1½".

The diameter of the high speed impeller is such that its peripheral edge is spaced only a small radial distance from the curved lugs 38 formed on the low speed impeller—about 3/16" or less and preferably ⅛" to ¼". It has been determined that this relatively small spacing between the blade periphery and the wall portions provided by the curved lugs provides an excellent shearing effect when the high and low speed impeller blades move relative to each other at substantially different speeds. This becomes particularly important when particles or agglomerates being dispersed in a fluid mixture are difficult to break up.

In an alternative construction an annular ring 40 may be attached to the lower side of the low speed impeller in substantially the same position as the lugs 38 as shown in FIG. 4. This annular ring also functions as a wall portion to cooperate with the peripheral edge of the high speed impeller in the same manner as the lugs 38.

In operation the speed of both motors may be varied independently between zero and maximum speed of the motors depending on the requirements of the materials being processed.

While certain preferred embodiments of the invention have been disclosed, it will be appreciated that these are shown by way of example only, and the invention is not to be limited thereto as other variations will be apparent to those skilled in the art and the invention is to be given its fullest possible interpretation within the terms of the following claims.

What is claimed is:

1. Apparatus for dispersing solid particles carried in suspension in a liquid vehicle comprising:

a motor drive assembly for driving a pair of coaxially disposed drive shafts;

a mounting frame for carrying said motor drive assembly;

a pair of coaxially disposed impeller drive shafts, connected to be driven by said motor drive assembly;

a multi-bladed low speed impeller of relatively large diameter carried by one of said drive shafts at the lower end thereof;

a high speed disc-type impeller of relatively small diameter carried by the other of said drive shafts at the lower end thereof;

said high speed impeller being disposed in coaxial relation with said low speed impeller and closely adjacent thereto;

wall means formed on said low speed impeller inwardly spaced from the outer periphery thereof and said wall means being radially spaced from the outer periphery of said high speed impeller a relatively small distance to allow for a high shear effect on particles in the fluid mixture being processed.

2. The apparatus of claim 1 wherein the distance between said wall means on said low speed impeller and the outer periphery of said high speed impeller is no more than about 3/16".

3. The apparatus of claims 1 or 2 wherein said wall means formed on said low speed impeller comprises lug members attached to said low speed impeller.

4. The apparatus of claim 3 wherein said motor drive assembly includes two variable speed motors for driving said drive shafts independently.

5. The apparatus of claim 4 wherein said high speed impeller is disposed at the lower side of said low speed impeller.

6. The apparatus of claims 1 or 2 wherein said wall means formed on said low speed impeller comprises a continuously extending ring member connected to said low speed impeller.

7. The apparatus of claims 1 or 2 wherein said high speed impeller is disposed in a recess formed in the lower side of said low speed impeller.

* * * * *